US007903033B2

(12) United States Patent
Bellows

(10) Patent No.: US 7,903,033 B2
(45) Date of Patent: Mar. 8, 2011

(54) ANTENNAS INCORPORATED IN A FITTED ACCESSORY OF A MOBILE UNIT

(75) Inventor: David Bellows, Wantagh, NY (US)

(73) Assignee: Symbol Technolgies, Inc., Holtsville, NY (US)

( * ) Notice: Subject to any disclaimer, the term of this patent is extended or adjusted under 35 U.S.C. 154(b) by 473 days.

(21) Appl. No.: 11/872,388

(22) Filed: Oct. 15, 2007

(65) Prior Publication Data

US 2009/0096680 A1 Apr. 16, 2009

(51) Int. Cl.
*H01Q 1/24* (2006.01)

(52) U.S. Cl. ..... 343/702; 343/797

(58) Field of Classification Search ..... 343/702, 343/700 MS, 795, 797, 770, 867
See application file for complete search history.

(56) References Cited

U.S. PATENT DOCUMENTS

| | | | | |
|---|---|---|---|---|
| 5,870,279 | A * | 2/1999 | Mahany et al. | 361/679.01 |
| 6,025,802 | A * | 2/2000 | Eggleston et al. | 343/700 MS |
| 6,563,042 | B2 * | 5/2003 | Barabash | 174/359 |
| 6,897,373 | B2 * | 5/2005 | Barabash | 174/377 |
| 2007/0182634 | A1 * | 8/2007 | Yamamoto et al. | 343/700 MS |
| 2007/0285320 | A1 * | 12/2007 | Hayes et al. | 343/702 |
| 2008/0122705 | A1 * | 5/2008 | Kurashima et al. | 343/702 |
| 2009/0066587 | A1 * | 3/2009 | Hayes et al. | 343/702 |

* cited by examiner

*Primary Examiner* — HoangAnh T Le

(57) ABSTRACT

A fitted accessory comprises two antennas incorporated within the fitted accessory. The fitted accessory also comprises an electrical contact coupling to a corresponding electrical contact disposed on the housing so that an electrical connection is established between the components of the fitted accessory and components in the housing. The fitted accessory couples to the housing.

10 Claims, 4 Drawing Sheets

ANTENNAS INCORPORATED IN A FITTED ACCESSORY OF A MOBILE UNIT

FIELD OF THE INVENTION

The present invention relates generally to two antennas incorporated in a fitted accessory such as an end cap or an add-on of a mobile unit. Specifically, the antennas are radio frequency identification antennas that are part of an overall housing design of the mobile unit.

BACKGROUND

A mobile unit (MU) may include a variety of different functionalities. For example, the MU may include a radio frequency identification (RFID) functionality. The RFID functionality requires an antenna to transmit and/or receive RFID signals. However, in many instances, the MU is initially sold without the RFID functionality. The RFID functionality is an accessory that may or may not be used with the MU. Therefore, the RFID functionality is often sold as an accessory for the MU. For example, the RFID functionality may be an add-on that includes components (e.g., an antenna, an RFID transceiver, etc.) connected externally to the MU. However, this add-on RFID technology makes an overall size of the MU increase, creates an inconvenient obstruction to an overall design of the MU, requires an intrusive operation for incorporation, etc.

SUMMARY OF THE INVENTION

The present invention relates to antennas incorporated into a fitted accessory of a mobile unit. The mobile unit comprises a main housing, an end cap, and two antennas. The end cap couples to the main housing creating an overall housing for the mobile unit. The two antennas are incorporated within the end cap.

The present invention relates to a fitted accessory for a housing of a mobile unit. The fitted accessory comprises two antennas incorporated within the fitted accessory. The fitted accessory also comprises an electrical contact coupling to a corresponding electrical contact disposed on the housing so that an electrical connection is established between the components of the fitted accessory and components in the housing. The fitted accessory couples to the housing.

DETAILED DESCRIPTION

Figure 1:
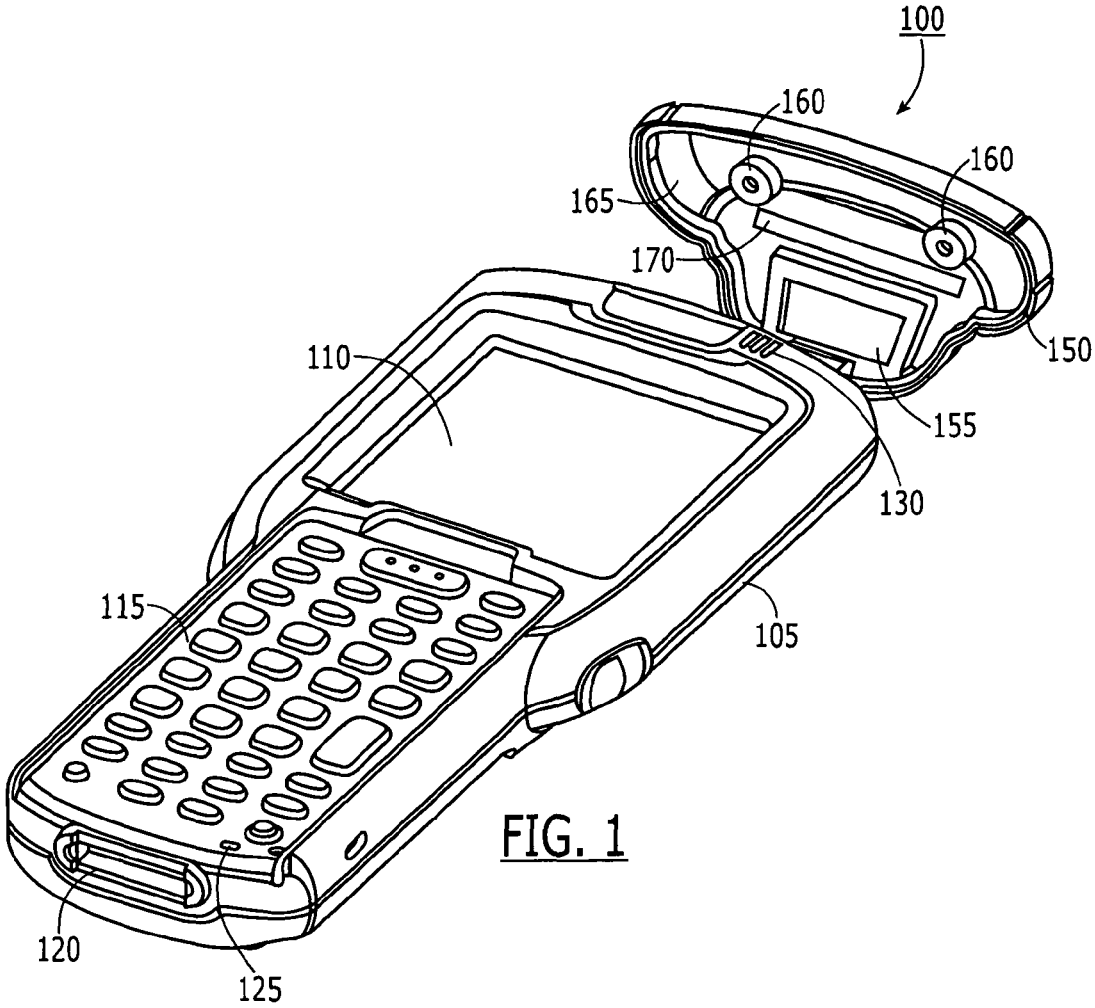
FIG. 1 shows a first exploded view of a mobile unit according to an exemplary embodiment of the present invention.

The exemplary embodiments of the present invention may be further understood with reference to the following description and the appended drawings, wherein like elements are referred to with the same reference numerals. The exemplary embodiments of the present invention describe two antennas incorporated in a fitted accessory of a mobile unit (MU). Specifically, in a first embodiment, the MU of the exemplary embodiments of the present invention may include a housing that utilizes an end cap on the housing. In a second embodiment, the MU of the exemplary embodiments of the present invention may include a housing configured to receive an add-on. The end cap or the add-on may include at least the antennas to execute radio frequency identification (RFID) functionalities. Thus, according to the exemplary embodiments of the present invention, components capable of executing the RFID functionalities may be incorporated into the MU without requiring an intrusive operation or creating an inconvenient obstruction to an overall design of the MU. The housing, the end cap, and the antennas will be discussed in more detail below.

Those skilled in the art will understand that while the exemplary embodiments describe RFID antennas, the exemplary embodiments may be modified to include an antenna or antennas that operate in other frequency spectra. In addition, the exemplary embodiments describe the fitted accessory as an end cap or an add-on. However, the fitted accessory may be designed to be located in other portions of the MU housing (e.g., the back or sides).

FIG. 1 shows a first exploded view of an MU 100 according to an exemplary embodiment of the present invention. The MU 100 may be any portable electronic device that utilizes a portable power supply (e.g., battery, capacitor, super capacitor, etc.). In particular, the MU 100 may be an RFID reading device. However, the MU 100 being an RFID device is only exemplary. That is, the MU 100 may also be a handheld terminal, a laptop, a pager, a cell phone, a scanner, etc. It should be noted that the use of the MU 100 is only exemplary. That is, the exemplary embodiments of the present invention may apply to any electronic device that utilizes an antenna. The MU 100 may include a main housing 105, a display 110, a data input arrangement 115, an input/output (I/O) port 120, an audio input 125, an audio output 130, an end cap 150, a scanner window 155, locking mechanisms 160, corresponding electrical contacts 165, and antennas 170. The scanner window 155, the locking mechanisms 160, and the corresponding electrical contacts 165 will be discussed in detail below with reference to FIG. 2.

The main housing 105 may be a first portion of an overall housing for the MU 100. The main housing 105 may also be an entire housing of the MU 100 that is configured to receive additional components. The main housing 105 may provide a casing in which components of the MU 100 may be at least partially disposed. That is, the components of the MU 100 may be wholly or partially within the main housing 105. For example, the display 110, the data input arrangement 115, the I/O port 120, the audio input 125, and the audio output 130, etc. may be disposed partially within the housing 105 so that a portion of these components are disposed on a periphery of the main housing 105. It should also be noted that other components of the MU 100 such as a processor, a memory, etc. may be disposed wholly within the main housing 105.

The display 110 may provide a user interface. Specifically, the user interface may be a graphical user interface (GUI). The data input arrangement 115 may be a keypad in which a user may enter various inputs. The inputs may correspond to at least one installed program or functionality of the MU 100. It should be noted that the display 110 may be a touch screen that enables a user to enter inputs thereon. That is, the data input arrangement 115 being a separate component is only exemplary. Thus, the MU 100 may include the display 110 and the data input arrangement 115, the display 110 with touch screen capabilities, or a combination thereof. It should also be noted that the data input arrangement 115 may include further keypads disposed on other peripheral areas of the housing 105 such as a side data input arrangement.

The I/O port 120 may be an access port in which other hardware components may electrically connect to the MU 100. For example, the I/O port 120 may be a universal serial bus (USB) port. In another example, the I/O port 120 may be an infrared (IR) port that is capable of exchanging data wirelessly.

The audio input 125 may be, for example, a microphone while the audio output 130 may be, for example, a speaker. The microphone and speaker may be disposed wholly within the main housing 105.

The end cap 150 may be a second portion of the overall housing of the MU 100. Specifically, the end cap 150 may be an end cap that is a complementary portion to the main housing 105. That is, the main housing 105 may be manufactured with an opening in which the end cap 150 provides a lid. For example, the overall housing of the MU 100 may be a clamshell design, a monocoque design, etc. The end cap 150 may also be an add-on that is received by the main housing 105. That is, as discussed above, the main housing 105 may be configured to receive the end cap 150. The end cap 150 may include the scanner window 155, the locking mechanisms 160, the corresponding contacts 165, and the antennas 170. As will be discussed in further detail below, the antennas 170 may be incorporated with the end cap 150.

According to the exemplary embodiments of the present invention, the antennas 170 may be wholly disposed within the end cap 150 toward an inner side. That is, the antennas 170 may not include any part that is exposed externally to the overall housing of the MU 100. The antennas 170 may also be configured so that the other components near the antennas 170 such as the scanner window 155 may still be disposed. For example, the antennas 170 may be shaped around the scanner window 155 so that a line of sight is not disrupted from a scanning component disposed behind the scanner window 155. The antennas 170 will be discussed in further detail below, particularly with reference to FIGS. 4-6.

Figure 2:
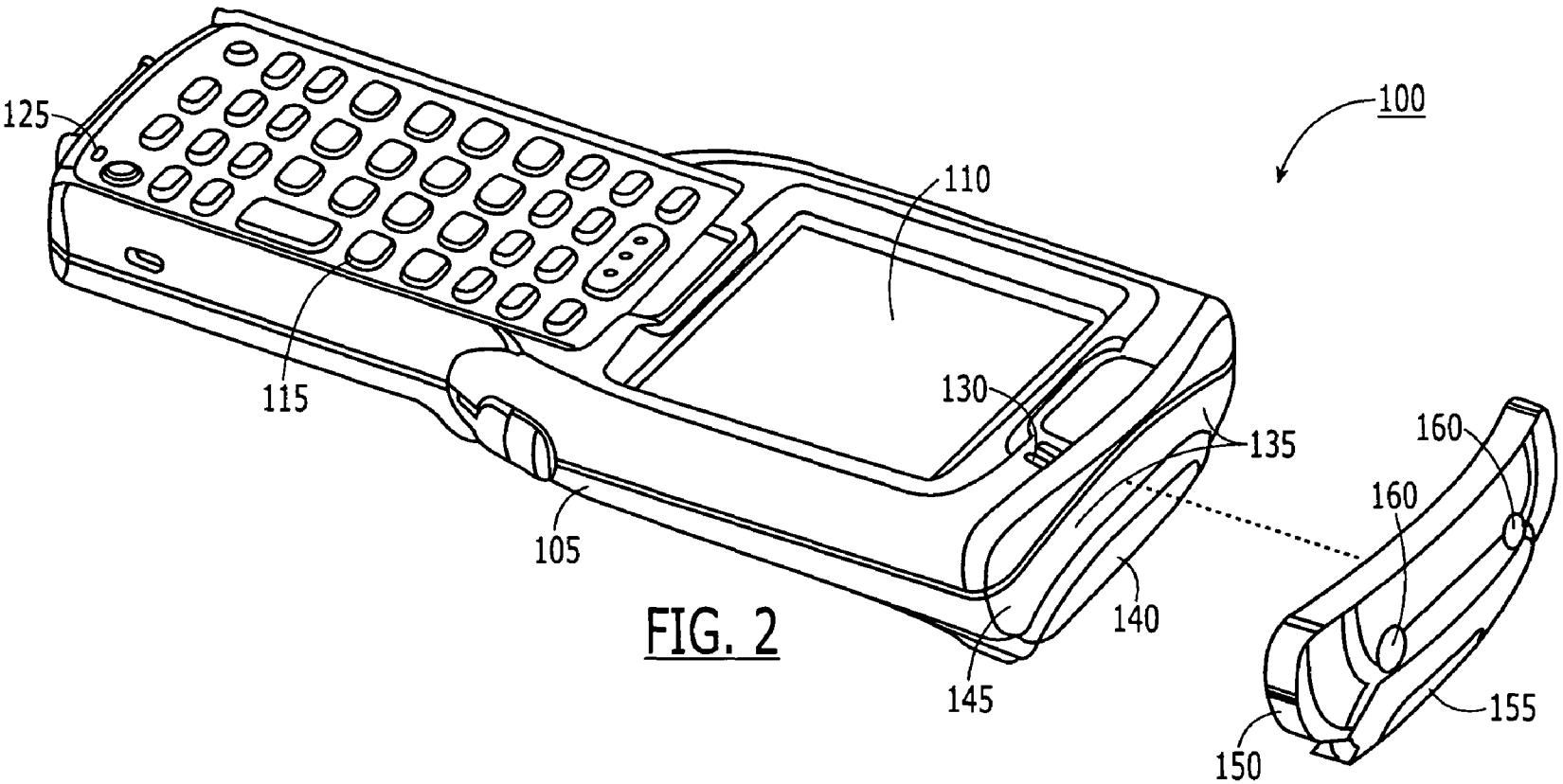
FIG. 2 shows a second exploded view of the mobile unit of FIG. 1 according to an exemplary embodiment of the present invention.

FIG. 2 shows a second exploded view of the MU 100 of FIG. 1 according to an exemplary embodiment of the present invention. Specifically, the second exploded view of the MU 100 shows a top side of the main housing 105 prior to assembly with the end cap 150. The second exploded view shows the main housing 105, the display 110, the data input arrangement 115, the audio input 125, the audio output 130, the end cap 150, the scanner window 155, and the locking mechanisms 160. In addition, the second exploded view shows corresponding locking mechanisms 135, a scanning engine 140, and electrical contacts 145.

When the end cap 150 is assembled with the main housing 105, the end cap 150 may be affixed using the locking mechanisms 160. The locking mechanisms 160 may be a stand alone device that performs the locking feature. For example, the locking mechanisms 160 may be an adhesive. However, in another embodiment, the locking mechanisms 160 may be coupled with the corresponding locking mechanisms 135. For example, the locking mechanisms 160 may be screws while the corresponding locking mechanisms 135 may be screw holes. In another example, the locking mechanisms 160 may be clips while the corresponding locking mechanism 135 may be mating slots or vice versa. In yet another example, the locking mechanisms 160 and the corresponding locking mechanisms may be a solenoid device. That is, the locking mechanisms 160 with the corresponding locking mechanisms 135 may be any type of attachment device that performs a locking through means that are mechanical, electrical, or a combination thereof.

The scanner window 155 may provide a transparent, protective via in which the scanning engine 140 may take scans. As discussed above, the scanning engine 140 may require a line of sight to an object to be scanned. For example, the scanning engine 140 may be a barcode (e.g., one-dimensional, two-dimensional) scanner. Thus, lasers from the scanning engine 140 may be produced and emitted through the scanner window 155 to the object. In other examples, the scanning engine 140 may be an imager, a camera, etc. Therefore, when the end cap 150 is assembled with the main housing 105, the scanner window 155 may be aligned with the scanning engine 140.

The electrical contacts 145 of the main housing 105 may couple to the corresponding electrical contacts 165 of the end cap 150. The coupling may establish an electrical connection for any components of the end cap 150 to, for example, the processor housed within the main housing 105. Because the antennas 170 are incorporated within the end cap 150, the antennas 170 require an electrical connection. That is, signals received or transmitted by the antennas 170 are sent to or originate from a source such as a transceiver or radio. According to the exemplary embodiments of the present invention, the transceiver or radio may be disposed in the main housing 105 or in the end cap 150. In a first embodiment where the transceiver/radio is disposed as part of the main housing 105 (e.g., part of a printed circuit board), the electrical contacts 145 may be a connector in which one end is connected to the transceiver/radio. In this embodiment, the transceiver/radio may already be connected to the processor. The corresponding electrical contacts 165 may be a connector in which one end is connected to the antennas 170. Therefore, when the electrical contacts 145 are coupled to the corresponding electrical contacts 165, an electrical connection may be established between the antennas 170 and the transceiver/radio. In a second embodiment where the transceiver/radio is disposed in the end cap 150, the electrical contacts 145 may be a connector in which one end is connected to the processor. The corresponding electrical contacts 165 may be a connector in which one end is connected to the transceiver/radio. In this embodiment, the antennas 170 may already be connected to the transceiver/radio. Therefore, when the electrical contacts 145 are coupled to the corresponding electrical contacts 165, an electrical connection may be established between the transceiver/radio and the processor. It should be noted that the electrical contacts 145 and the corresponding electrical contacts 165 may be coupled in a variety of manners. For example, the electrical contacts 145 may be conducting extensions that are received by the corresponding electrical contacts 165 that are conducting recesses. In another example, the electrical contacts 145 and the corresponding electrical contacts 165 may include conducting pads that contact each other.

As discussed above, the antennas 170 may be incorporated within the end cap 150. Specifically, the antennas 170 may conform to an inner side of the end cap 150. The antennas 170 may be used for the RFID functionalities. Because the antennas 170 and possibly the transceiver/radio in which the antennas 170 are connected (e.g., directly or indirectly) are incorporated in the end cap 150, the RFID functionalities may be provided to the MU 100 through replacement of an end cap without an incorporated antenna with the end cap 150 according to the exemplary embodiments of the present invention. In this manner, neither an intrusive operation is necessary nor an obtrusive protuberance is created. In addition, RFID functionalities may be provided to the MU 100 with no end cap through the addition of the end cap 150 according to the exemplary embodiments of the present invention.

Ultra high frequency (UHF) RFID functionalities generally operate between 902 MHz and 928 MHz. Thus, a single sine wave of the RFID wave is between $1.103\times10^{-9}$ seconds and $1.078\times10^{-9}$ seconds, respectively. Half a wavelength for the RFID wave at the UHF band is thus between $5.543\times10^{-10}$ seconds and $5.388\times10^{-10}$ seconds, respectively. Because the waves are measured against the speed of light, an optimal length for these operating parameters is between 6.54 inches and 6.36 inches, respectively. It should be noted that the half a wavelength being a first optimal length is only exemplary. Other exemplary optimal lengths may include a quarter wavelength and a three-quarters wavelength. The quarter wavelength may correspond to 3.27 inches to 3.18 inches while the three-quarters wavelength may correspond to 9.81 inches to 9.54 inches. Thus, the antennas 170 may exhibit any predetermined length corresponding to an appropriate wavelength for the RFID functionality (e.g., half wavelength, quarter wavelength, three-quarters wavelength).

As explained above, a proper electrical length of the antennas for RFID functionalities operating between 902 MHz and 928 MHz is between 6.54 inches and 6.36 inches, respectively. Depending on the capacitive and inductive loading of the antennas, the physical length may be greater than or less than this range. For example, the presence of an end-loading capacitor may change the necessary physical length of the antennas 170 to create functional RFID antennas. Further dimensions and styles for the antennas 170 will be discussed in detail below with reference to FIGS. 4-6.

Figure 3:
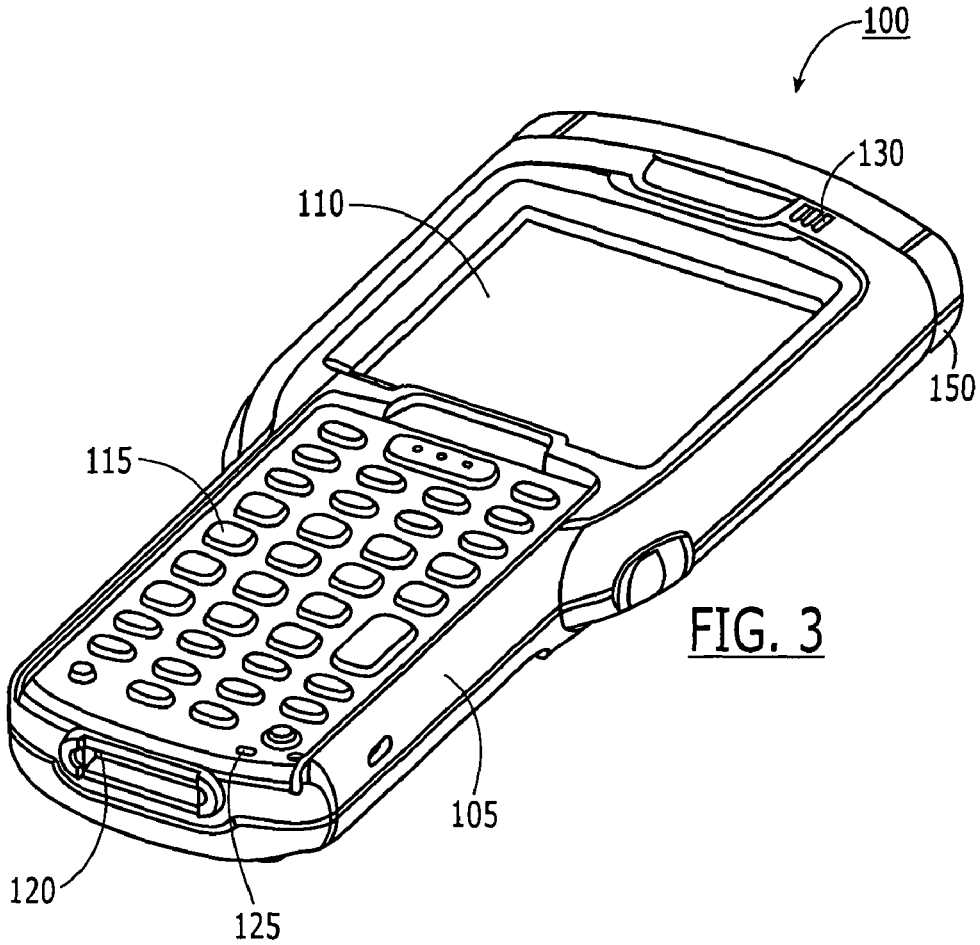
FIG. 3 shows an assembled view of the mobile unit of FIG. 1 according to an exemplary embodiment of the present invention.

FIG. 3 shows an assembled view of the MU 100 of FIG. 1 according to an exemplary embodiment of the present invention. The assembled view of the MU 100 illustrates when the main housing 105 is coupled with the end cap 150. The assembled view also shows the display 110, the data input arrangement 115, the I/O port 120, the audio input 125, and the audio output 130.

As discussed above, when the main housing 105 is coupled to the end cap 150, the locking mechanisms 160 may be coupled to the corresponding locking mechanisms 135. Furthermore, the electrical contacts 145 may be coupled to the corresponding electrical contacts 165. In addition, the scanner window 155 may be aligned with the scanning engine 140. The end cap 150 may be coupled to the main housing 105 so that a flush exterior is created for the overall housing of the MU 100. That is, the outer periphery of the end cap 150 that contacts the main housing 105 may exhibit dimensions of the outer periphery of a top side of the main housing 105. As illustrated, the antennas 170 may be wholly disposed between the main housing 105 and the end cap 150 so that no portion of the antennas 170 is exposed.

Figure 4:
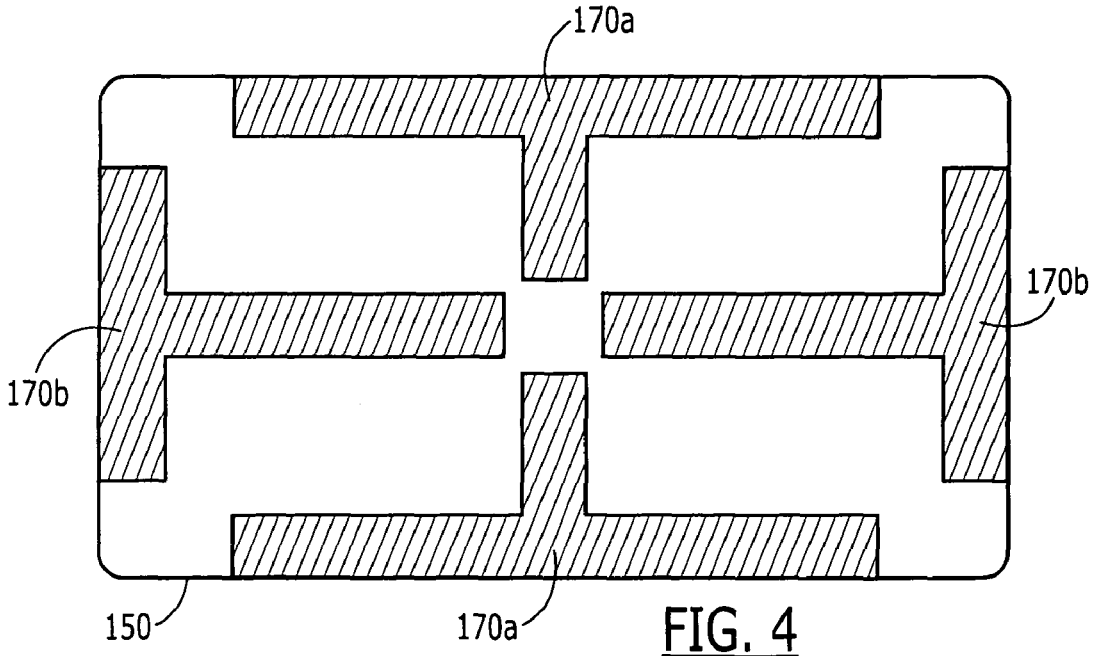
FIG. 4 shows first exemplary antennas incorporated into an end cap of the mobile unit of FIG. 1 according to an exemplary embodiment of the present invention.

FIG. 4 shows first exemplary antennas 170 incorporated into the end cap 150 of the MU 100 of FIG. 1 according to an exemplary embodiment of the present invention. Specifically, the first exemplary antennas 170 exhibit a substantial cross configuration including a first antenna 170*a* and a second antenna 170*b*. That is, the antenna design of the first exemplary antenna 170 is a dual-dipole with one vertical dipole (i.e., the first antenna 170*a*) and one horizontal dipole (i.e., the second antenna 170*b*). As illustrated, the first antenna 170*a* and the second antenna 170*b* are disposed on an inner side of the end cap 150. Furthermore, the first antenna 170*a* and the second antenna 170*b* may conform to an inner surface of the end cap 150.

According to an exemplary embodiment of the present invention, the MU 100 may include cross-sectional dimensions of, for example, three inches by one and a half inches (i.e., 3"×1.5"). Thus, the end cap 150 may also include these dimensions. As discussed above, the antennas 170 may exhibit predetermined lengths corresponding to half a wavelength for the RFID functionality. For example, either one of the antennas 170*a* or 170*b* may be approximately 6 inches long. The constraints of the size of the end cap 150 prevent linear antennas 170 from being disposed therein without a portion extending to an outer area of the MU 100. However, the dual-dipole configuration of the first exemplary antennas 170 allows the approximately 6 inch electrically long antennas to be disposed in the end cap 150. As illustrated, the dual-dipole includes two antennas that are substantially T-shaped. The disposition and the lengths of the first antenna 170*a* results in an antenna that is electrically approximately 6 inches. Furthermore, the disposition and the lengths of the second antenna 170*b* results in an antenna that is also electrically approximately 6 inches. As discussed above, the 6 inch length of the antenna corresponds to half a wavelength of the RFID frequency.

Figure 5:
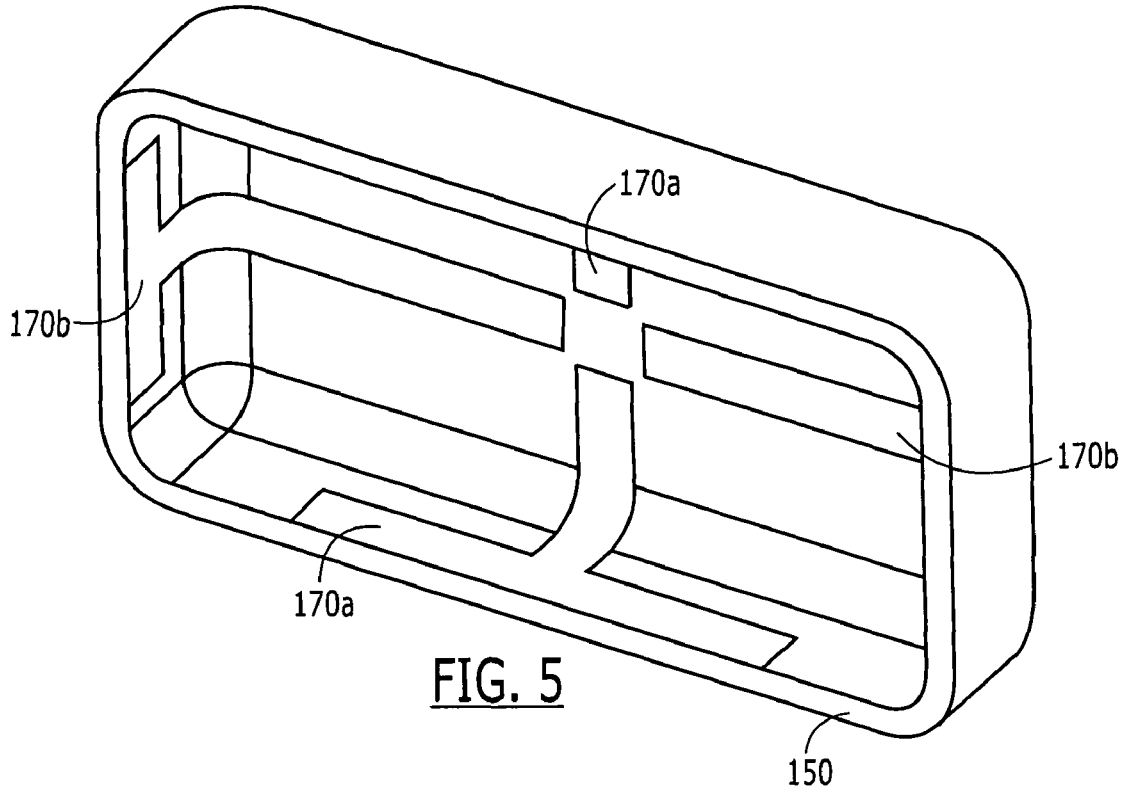
FIG. 5 shows a perspective view of the first exemplary antennas of FIG. 4 according to an exemplary embodiment of the present invention.

FIG. 5 shows a perspective view of the first exemplary antennas 170 of FIG. 4 according to an exemplary embodiment of the present invention. As discussed above, the first antenna 170*a* and the second antenna 170*b* may conform to an inner surface of the end cap 150. The perspective view of the first exemplary antennas 170 illustrates the conforming shape of the first antenna 170*a* and the second antenna 170*b*. Also, as discussed above, the first antenna 170*a* and the second antenna 170*b* may be T-shaped. Thus, a first leg of the T-shape may be disposed on one of the side walls of the end cap 150. A second leg of the T-shape may extend from a middle of the first leg toward a center of the end cap 150. The extension of the second leg may curve (when the end cap 150 has rounded edges) or may be fitted into a corner (when the end cap 150 has sharp edges) of the end cap 150.

Figure 6:
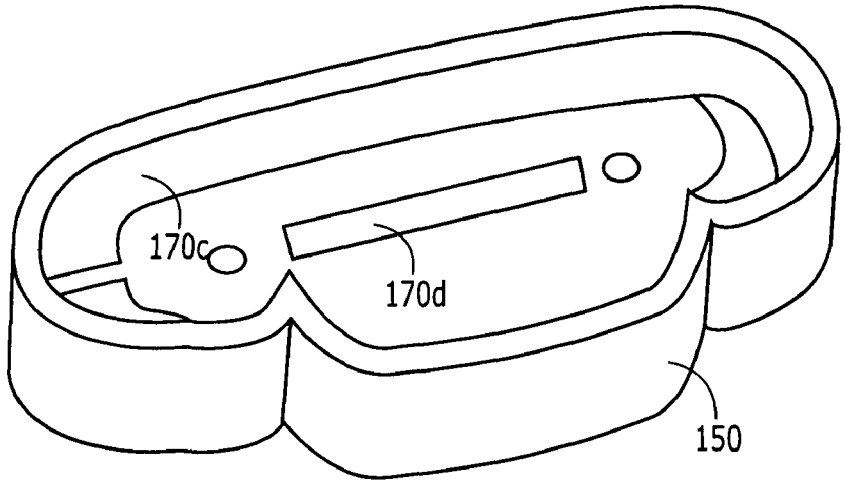
FIG. 6 shows second exemplary antennas incorporated into an end cap of the mobile unit of FIG. 1 according to an exemplary embodiment of the present invention.

FIG. 6 shows second exemplary antennas 170 incorporated into the end cap 150 of the MU 100 of FIG. 1 according to an exemplary embodiment of the present invention. Specifically, the second exemplary antennas 170 may include a vertically polarized loop antenna 170*c* and a horizontally polarized chip antenna 170*d*. The antenna 170*c* may conform to an inner side area of the end cap 150. That is, the antenna design of the loop antenna 170*c* covers substantially an entire side surface of an inner side of the end cap 150. It should be noted that the loop antenna 170*c* may not cover predetermined areas of the inner side of the end cap 150. For example, the loop antenna 170*c* may circumscribe an area in which the scanner window 155 is disposed.

Furthermore, the parameters of the loop antenna 170*c* (e.g., length, shape, thickness, conductivity, etc.) may be constructed so that the loop antenna 170*c* may exhibit various parameters relating to RFID functionalities and optimized performance thereof. The chip antenna 170*d* may be mounted in the end cap 150 to provide a polarization orthogonal to the loop antenna 170*c*. According to the exemplary embodiment of the second exemplary antennas 170, the loop antenna 170*c* may exhibit a vertical polarity. Thus, the chip antenna 170*d* may exhibit a horizontal polarity.

It should be noted that the terms horizontally polarized and vertically polarized are exemplary. According to the exemplary embodiments of the present invention, the antennas 170 in the end cap 150 are substantially orthogonal to each other. Those skilled in the art will understand that one embodiment that satisfies antenna orthogonality is a horizontally polarized antenna with a vertically polarized antenna. However, if both antennas were rotated 45 degrees, the terms "horizontally polarized" and "vertically polarized" may not be used, but the antennas 170 would still be orthogonal.

According to the exemplary embodiments of the present invention, the loop antenna 170*c* may be manufactured of a copper tape or a flex. However, it should be noted that other materials may be used that exhibit substantially similar signal propagation/reception properties as copper. The loop antenna 170*c* may be disposed along the inner side wall of the end cap 150 so that an overall electrical length may also be optimized. It should be noted that certain regions of the loop antenna 170*c* may be wider or narrower to properly load the antenna 170 with capacitance and/or inductance so that the loop antenna 170*c* may properly execute the RFID functionalities.

It should be noted that the antennas 170 being dual-dipole antennas or a loop antenna with a chip antenna are only exemplary. Other types of antennas 170 may also be used such as monopole antennas, slot antennas, or any combination thereof. That is, the horizontally polarized antenna and the vertically polarized antenna may be any combination of antenna styles and may be substantially orthogonal to each other. Other antennas may be configured using substantially similar parameters as the dual-dipole antenna, the loop antenna, or the chip antenna. That is, a physical length may vary depending on a capacitive and/or inductive loading of the antennas. However, an electrical length may always be optimized for a specific style of antennas that are employed.

Because the exemplary embodiments of the present invention utilizes two antennas that are orthogonal to each other, the MU 100 may switch between the two antennas for the RFID functionalities. The switching of the antennas 170 may entail utilizing a first antenna (e.g., antenna 170*a* or antenna 170*c*) while keeping a second antenna (e.g., antenna 170*b* or antenna 170*d*) idle. Subsequently, the second antenna may be utilized while the first antenna is idle. This process may repeat as necessary for the RFID functionality. The use of two antennas and the switching thereof may provide a user with orthogonal diversity. The user of the MU 100 may read RFID tags regardless of an orientation of the MU 100. For example, if an RFID tag is oriented vertically, the vertically polarized antenna may read the tag while a horizontally oriented RFID tag may be read by the horizontally polarized antenna. Those skilled in the art will understand that if only one polarized antenna is disposed, the MU 100 may require to be properly oriented (e.g., physically rotating the MU 100) in order to read the RFID tag. The antennas 170 of the exemplary embodiments of the present invention eliminate the need for the MU 100 to be properly oriented.

It will be apparent to those skilled in the art that various modifications may be made in the present invention, without departing from the spirit or scope of the invention. Thus, it is intended that the present invention cover the modifications and variations of this invention provided they come within the scope of the appended claims and their equivalents.

What is claimed is:

1. A fitted accessory for a housing of a mobile unit, comprising:

two antennas incorporated within the fitted accessory, wherein the two antennas are orthogonal to each other; and an electrical contact coupling to a corresponding electrical contact disposed on the housing so that an electrical connection is established between components of the fitted accessory and components in the housing, the fitted accessory coupling to the housing, wherein the housing consists of an entire closed-off set of exterior surfaces with no openings.

2. The fitted accessory of claim 1, further comprising:

a transceiver connected to the antennas, the transceiver being connected to the electrical contact.

3. The fitted accessory of claim 1, wherein the antennas are connected to the electrical contact so that when the fitted accessory is coupled to the housing, the antennas are electrically connected to a transceiver disposed within the housing.

4. The fitted accessory of claim 1, wherein the antennas are one of monopole antennas, slot antennas, and a combination thereof.

5. The fitted accessory of claim 1, wherein three inch long antennas correspond to a quarter wavelength of an RFID frequency, six inch long antennas correspond to a half wavelength of the RFID frequency, and nine inch long antennas correspond to a three-quarter wavelength of the RFID frequency.

6. The fitted accessory of claim 1, further comprising:

a locking mechanism affixing the fitted accessory to the housing.

7. The fitted accessory of claim 6, wherein the locking mechanism is one of screws, a solenoid, adhesive, a latch, and a clip.

8. The fitted accessory of claim 1, wherein the two antennas are a vertically-polarized loop antenna and a horizontally-polarized chip antenna.

9. The mobile unit of claim 1, wherein the two antennas are perpendicular dual-dipole antennas, one being a vertical dipole and the other being a horizontal dipole.

10. The fitted accessory of claim 1, wherein switching between the two antennas provides a polarization of 360°.

* * * * *

UNITED STATES PATENT AND TRADEMARK OFFICE

CERTIFICATE OF CORRECTION

PATENT NO. : 7,903,033 B2
APPLICATION NO. : 11/872388
DATED : March 8, 2011
INVENTOR(S) : Bellows It is certified that error appears in the above-identified patent and that said Letters Patent is hereby corrected as shown below:

On the Title Page, in item (73), under "Assignee", in Column 1, Line 1, delete "Technolgies," and insert -- Technologies, --, therefor.

In Column 1, Line 44, in Heading, before "DESCRIPTION", insert -- BRIEF --.

In Column 8, Line 44, in Claim 9, delete "mobile unit" and insert -- fitted accessory --, therefor.

Signed and Sealed this
Fourth Day of December, 2012

David J. Kappos

David J. Kappos
*Director of the United States Patent and Trademark Office*